US006867685B1

(12) United States Patent
Stillwagon

(10) Patent No.: US 6,867,685 B1
(45) Date of Patent: Mar. 15, 2005

(54) ELECTRO-MECHANICAL LOCK ASSEMBLY

(75) Inventor: Woodrow C. Stillwagon, Atlanta, GA (US)

(73) Assignee: Star Lock Systems, Inc., Hilliard, OH (US)

( * ) Notice: Subject to any disclaimer, the term of this patent is extended or adjusted under 35 U.S.C. 154(b) by 0 days.

(21) Appl. No.: 09/567,696

(22) Filed: May 9, 2000

Related U.S. Application Data

(60) Provisional application No. 60/133,482, filed on May 10, 1999.

(51) Int. Cl.[7] ..... E05B 47/00; E05B 15/02

(52) U.S. Cl. ..... 340/5.64; 340/5.61; 70/277; 292/341.16; 292/341.17

(58) Field of Search ..... 340/5.64, 5.61, 340/5.62, 5.63, 5.65, 5.6, 5.66, 5.67; 70/34, 277, 208; 292/341.16, 341.17

(56) References Cited

U.S. PATENT DOCUMENTS

| | | | | |
|---|---|---|---|---|
| 1,262,435 A | | 4/1918 | Berg | |
| 2,727,772 A | | 12/1955 | Hamilton | 292/144 |
| 3,089,330 A | | 5/1963 | Kerr | 70/140 |
| 3,111,833 A | | 11/1963 | Dettmer | 70/140 |
| 3,122,012 A | | 2/1964 | Christopher | 70/140 |
| 3,222,899 A | | 12/1965 | Bodoh et al. | 70/140 |
| 3,285,043 A | | 11/1966 | Dauenbaugh et al. | 70/208 |
| 3,299,678 A | | 1/1967 | Spencer | 70/208 |
| 3,302,434 A | | 2/1967 | Dauenbaugh et al. | 70/208 |
| 3,438,227 A | | 4/1969 | Wolniak | 70/208 |
| 3,753,316 A | | 8/1973 | Savarieau et al. | 49/31 |
| 3,834,198 A | | 9/1974 | Wiczer | 70/208 |
| 3,911,534 A | | 10/1975 | Martens et al. | 24/150 R |
| 3,919,869 A | | 11/1975 | Fromm | 70/263 |
| 3,947,930 A | | 4/1976 | Martens et al. | 24/155 BR |
| 4,031,434 A | * | 6/1977 | Perron et al. | 361/172 |
| 4,196,347 A | | 4/1980 | Hadley | 455/603 |

(List continued on next page.)

FOREIGN PATENT DOCUMENTS

| | | |
|---|---|---|
| DE | 2633669 | 7/1976 |
| EP | 0117204 | 2/1984 |

OTHER PUBLICATIONS

Medico Security Switch Locks Brochure.
Inductors for Distributed Power Supplies—1995—Siemens Matsushita Components—pp. 1–3.

*Primary Examiner*—Brian Zimmerman
*Assistant Examiner*—Clara Yang
(74) *Attorney, Agent, or Firm*—Womble Carlyle Sandridge & Rice, PLLC

(57) ABSTRACT

An electro-mechanical lock release assembly for an enclosure such as a vending machine and including an electronic lock controller for disengaging a lock assembly securing the door of the enclosure against the enclosure frame in a closed, locked position. The lock controller is actuated remotely through a key controller to disengage the lock assembly and enable the door of the enclosure to be moved to an open position for accessing the enclosure.

17 Claims, 8 Drawing Sheets

U.S. PATENT DOCUMENTS

| | | | | | |
|---|---|---|---|---|---|
| 4,306,219 | A | * | 12/1981 | Main et al. | 70/276 |
| 4,438,962 | A | | 3/1984 | Soloviff et al. | 292/144 |
| 4,552,001 | A | | 11/1985 | Roop | 70/208 |
| 4,663,952 | A | | 5/1987 | Gelhard | 70/278 |
| 4,760,721 | A | | 8/1988 | Steinbach | 70/208 |
| 4,838,055 | A | | 6/1989 | Gallagher | 70/208 |
| 4,899,561 | A | | 2/1990 | Myers | 70/208 |
| 4,916,927 | A | * | 4/1990 | O'Connell et al. | 194/205 |
| 4,967,305 | A | * | 10/1990 | Murrer et al. | 340/10.41 |
| 4,993,247 | A | | 2/1991 | Minemura | 70/208 |
| 5,022,243 | A | | 6/1991 | Embry et al. | 70/34 |
| 5,027,630 | A | | 7/1991 | Stillwagon et al. | 70/391 |
| 5,038,588 | A | | 8/1991 | Hall | 70/208 |
| 5,050,413 | A | | 9/1991 | Stillwagon et al. | 70/386 |
| 5,140,317 | A | | 8/1992 | Hyatt, Jr. et al. | 340/825.31 |
| 5,197,314 | A | | 3/1993 | Stillwagon et al. | 70/386 |
| 5,269,161 | A | | 12/1993 | Stillwagon | 70/34 |
| 5,272,894 | A | | 12/1993 | Stillwagon et al. | 70/208 |
| 5,392,025 | A | | 2/1995 | Figh et al. | 340/545 |
| 5,442,348 | A | * | 8/1995 | Mushell | 221/7 |
| 5,467,619 | A | | 11/1995 | Stillwagon et al. | 70/34 |
| 5,575,515 | A | * | 11/1996 | Iwamoto et al. | 70/279.1 |
| 5,602,744 | A | | 2/1997 | Meek et al. | 364/464.22 |
| 5,636,881 | A | | 6/1997 | Stillwagon | 292/150 |
| 5,712,626 | A | | 1/1998 | Andreou et al. | 340/825.31 |
| 5,746,458 | A | | 5/1998 | Fisher | 292/252 |
| 5,808,558 | A | | 9/1998 | Meek et al. | 340/870.01 |
| 5,813,257 | A | | 9/1998 | Claghorn et al. | 70/208 |
| 6,005,487 | A | | 12/1999 | Hyatt, Jr. et al. | 340/825.31 |

* cited by examiner

ELECTRO-MECHANICAL LOCK ASSEMBLY

This application claims benefit of Provisional 60/133,482 filed May 10, 1999.

BACKGROUND OF THE INVENTION

Locking devices commonly are used to hold lids, doors or other closure elements of boxes, cabinets, doorways and other framed structures in closed and/or locked positions, and further typically are used to provide some measure of security against unauthorized or inadvertent access. For example, conventional vending machines generally include a key operated T-handle locking device that typically includes a locking assembly and a post mounted to the frame and door of the vending machine so that the door of the vending machine is locked when moved into a closed position against the machine frame by the insertion of the post into the retention element in a bracket assembly. Such locking assemblies further typically include a housing that defines an axial passage in which the post is attached to and/or operating in conjunction with a T-handle, is received and is engaged by a retention element that engages the surface of the post. The retention element grips the post and preclude its withdrawal from the axial passage of the lock housing.

Typically, to disengage the retention element from the post, the locking assembly utilizes a key lock in which a key is received, and, as the key is turned, the bolt element of the T-handle assembly is released from engagement with the T-handle's outer housing and causing the T-handle to extend outward under the influence of a compression spring. The extended T-handle is then rotated to disengage the post to enable the door or other closure element to which the retention element is mounted to be opened. Examples of such locking assemblies for use with vending machines or similar enclosures are disclosed in U.S. Pat. Nos. 5,050,413, 5,022,243 and 5,467,619. Such an unlocking or opening operation generally is a substantially manual operation such that most locking assemblies generally are limited in their placement to regions or areas where they can be readily reached and operated, i.e., in the middle of the door. Such easy access to these locking assemblies, however, tends to make these locking assemblies easy targets for vandals or thieves that can shield their actions from view while attacking the security of the enclosure by picking or smashing the lock to remove the primary and sometimes only point of security between the door and the frame of the enclosure.

In particular, vending machines have become an increasingly favorite target of vandals and thieves. The popularity of vending machines has greatly increased in recent years, especially in remote areas for providing ready access to an increasing variety of goods including food and drinks, stamps, and higher priced items such as toys and cameras, all without requiring human intervention. At the same time, the capacities of conventional vending machines have increased significantly so as to not only provide consumers with more choices, thus creating more opportunities for sales, but further to increase the time interval between servicing or restocking that is required for the vending machines. For example, the typical soft drink vending machine has increased in capacity from approximately 420 cans to approximately 800 cans. The increased popularity and increased capacity of vending machines as well as the expansion of products to higher priced items have significantly increased the amounts of money taken in by vending machines, providing an increasingly attractive target to thieves and vandals. Further, if the key to one of these locking assemblies or locking devices is lost or stolen, all the locks accessible by such key must be "re-keyed" to maintain controlled access and security. Such re-keying is typically burdensome and very costly, especially where there are a significant number of locks that need to be re-keyed. Accordingly there is an increasing interest in improving the security of locking assemblies for securing the doors or other closure devices of vending machines and similar enclosures.

There is, therefore, a need for improved locking systems and methods that address these and other related and unrelated problems.

SUMMARY OF THE INVENTION

Briefly described, the present invention generally comprises an electro-mechanical lock assembly or system for securing a door or other closure device for enclosures such as vending machines, trailers, etc. The electro-mechanical locking apparatus of the present invention is designed to provide enhanced security for the enclosure and to additionally provide for data collection and transfer of information to enable more accurate tracking business activity. Typically, the enclosure to which the electro mechanical lock assembly of the present invention is applied will include an enclosure frame and at least one door hingedly attached to the enclosure frame so as to be movable between an unlocked, open position displaced from the enclosure frame and a closed, locked position secured against the enclosure frame.

The electro-mechanical lock assembly generally includes a T-handle having a mechanical lock and an electronic lock control system. The mechanical lock secures the T-handle in a T-handle housing and prevents the rotation of the locking post. A T-handle lock bolt is disengaged or actuated remotely through the electronic lock control system.

The electronic lock control system or assembly is generally mounted on the inside of the outer door of the enclosure and controls the operation of a solenoid for disengaging or releasing the mechanical lock from its locked condition to enable unlocking and thus opening of the door of the enclosure. The electronic lock control system generally includes an electronic lock controller and a data/power link or transceiver mounted to the front of the door. Typically, the lock controller includes a microprocessor and memory for storing data or information such as when, where and how long the door has been opened and by whom, a capacitor and a relay switch. The data/power link typically comprises an inductive coupling such as ferrite coil which enables indirect, inductive power transfer through the door over a desired air gap. A data transfer thereafter is accomplished through electromagnetic dynamics, radio frequency transfer and/or an infrared link. The data/power link is connected to the electronic lock controller to provide the transfer of power, data link and energy to operate the electronic lock release.

A hand held key/data transmitter provides power, and data signals and commands to the electronic lock controller via the data/power link mounted to the door. The key/data transmitter typically will have a mating data/power link, i.e., inductive ferrite coil, a power supply such as a battery, and typically includes a display such as a touch screen or a LCD screen and/or key-pad for entry and review of data to be transferred to and received from the electronic lock controller. As the key/data transmitter is actuated, it sends power and data signals through the door to the data power link and to the lock controller to power the controller and identify the key controller. Upon verification of the key controller personal identification number (PIN) and that the key controller is authorized to access the enclosure, programming updates and/or other data are transferred between the key/data transmitter and the lock controller. Thereafter, the lock controller sends a signal or pulse to an actuator for the mechanical locking assembly to energize and cause the locking assembly to disengage and allow the user or operator to unlock and open the door.

The mechanical locking assembly can include a conventional T-handle and post assembly. The mechanical locking assembly is actuated by the electronic lock controller and generally includes an inner lock housing mounted to the enclosure frame and having an axial passage formed therethrough into which a series of locking elements. A post assembly is mounted to the door opposite the retention element. The post assembly includes an outer lock housing mounted to and projecting through the door, and a handle portion received within the outer lock housing. An elongated post or shaft is slidably mounted to the handle at its proximal end and includes a locking element at its distal end. The locking element about the distal end of the post are adapted to engage the retention elements of the inner lock housing to secure the post to the inner lock housing when the door is in its closed and locked position.

The handle generally includes a handle body received within the outer lock housing and having an open-ended passage formed at its other end in which the proximal end of the post or shaft is received. A locking element or bolt is positioned along the handle body and is biased outwardly from the handle body. The bolt projects through and engages the outer lock housing when the handle is in a depressed, locked position with the door secured against the enclosure frame. A mounting or support saddle is received and fits over the outer lock housing for supporting a lock release mechanism in an operative position in engagement with the mechanical locking assembly. The release mechanism includes an actuator mounted adjacent the outer lock housing, which typically includes a solenoid, and a release element such as a pivoting or sliding arm or plate. As the solenoid is actuated, the arm or plate engages and urges the locking element of the handle body downwardly and out of engagement with the outer lock housing to release the handle to thus enable the post to be disengaged from the inner lock housing. Thereafter, the door is free to be moved to its unlocked position spaced from the enclosure frame.

After the operator performs the desired tasks/operations for the enclosure, the operator can enter additional data or programming information such as repair or work orders for the machine or stocking information into the key/data transmitter and thereafter closes and locks the door. The information stored in the key/data transmitter, such as the amount of stock input into a certain vending machine or machines, the service time required to service a machine, or a repair order, will be downloaded from the key/data transmitter to a central server or computer at the operator's plant or base of operations for generation of reports and analysis of service data. The key/data transmitter further can be reprogrammed with new or additional route information, including a different PIN or identification numbers or other programming information as well as charging of the power source for the key/data transmitter.

Various objects, features and advantages of the present invention will become apparent to those skilled in the art upon reading the following detailed description, when taken in conjunction with the accompanying drawings.

DETAILED DESCRIPTION OF THE PREFERRED EMBODIMENTS

Figure 1:
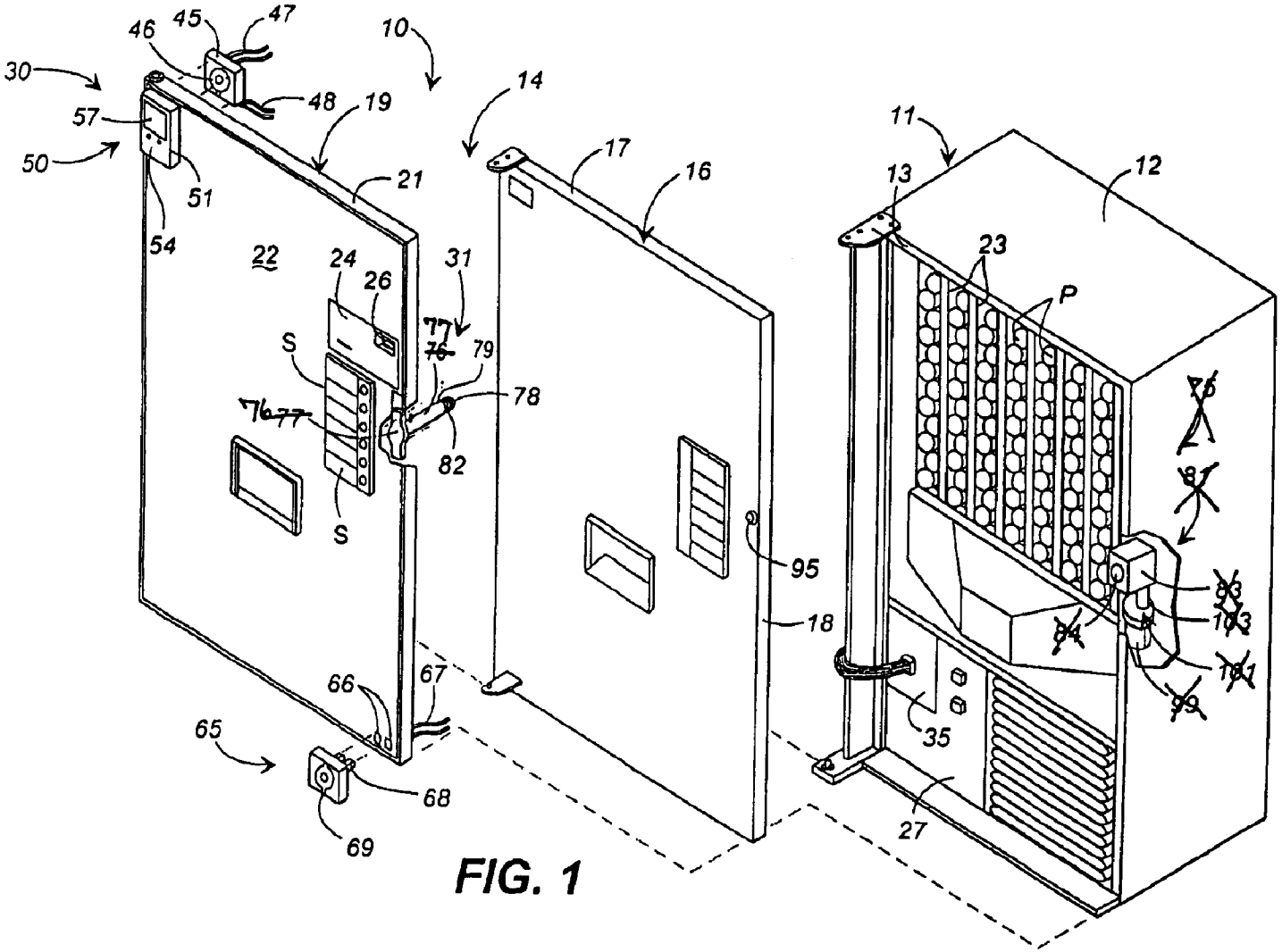
FIG. 1 is an exploded perspective view of the present invention of an electro-mechanical lock assembly as applied to a vending machine in an exemplary embodiment.
Figure 2:
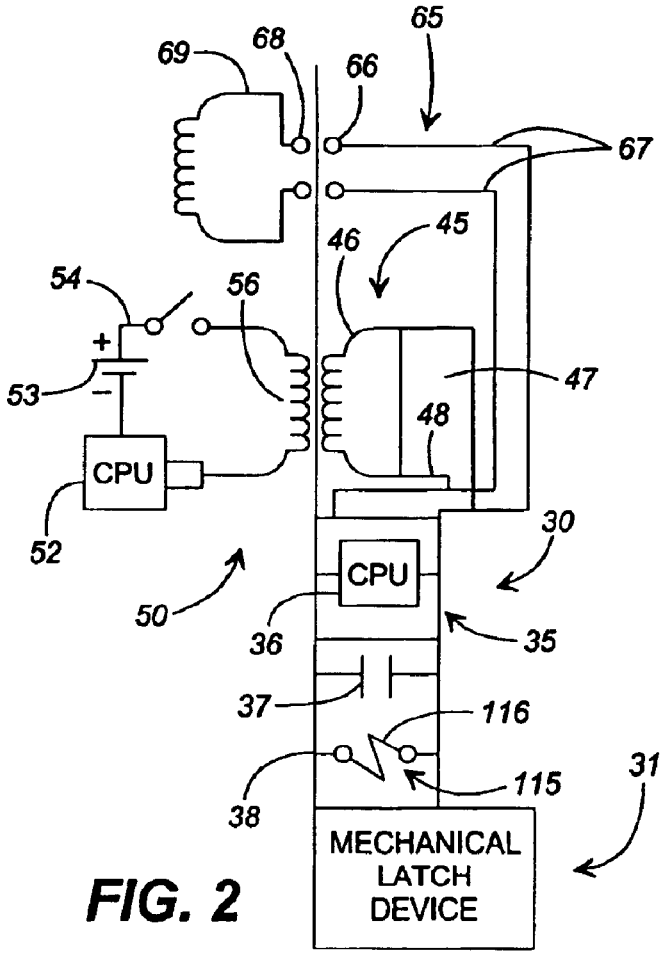
FIG. 2 is a schematic illustration of the lock controller and the circuit of the lock control assembly of the present invention.
Figure 3:
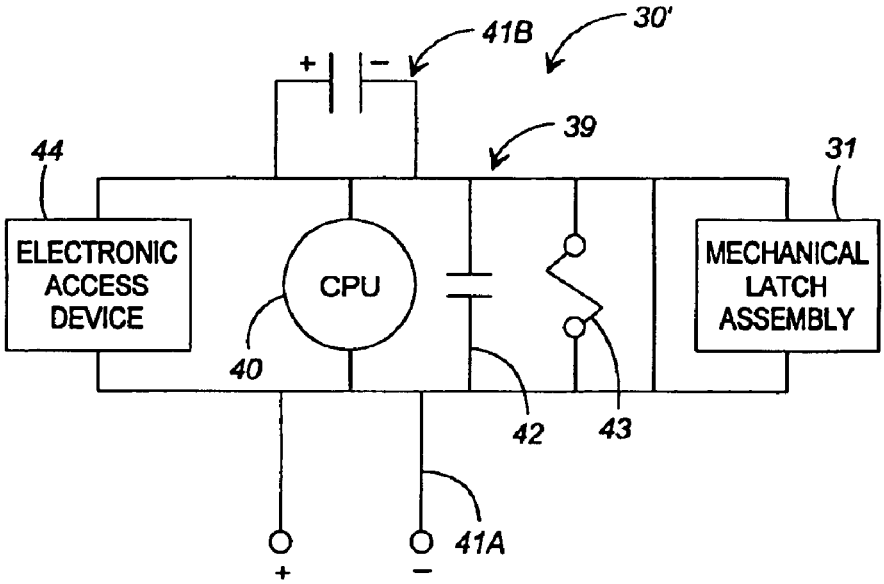
FIG. 3 is a schematic illustration an additional embodiment of the circuit for operation of the lock control assembly of the present invention.

Referring now to the drawings in greater detail in which like numerals indicate like parts throughout the several views, FIGS. 1–3 illustrate an electro-mechanical lock or locking assembly 10 for locking or securing and thus restricting access to an enclosure, as illustrated at 11 in FIG. 1, and which further enables recording and transfer of information and data between a control system for the enclosure and an operator key or control unit, such as who accessed the enclosure and at what times, and stocking data, etc. The enclosure 11 is generally illustrated in FIG. 1 as a vending machine such as a soft drink machine, for purposes of illustration. It will, however, be understood by those skilled in the art that the electro-mechanical lock assembly 10 of the present invention can be applied to various types of enclosures including vending machines, automated teller machines, cabinets, storage units and other, similar types of enclosures.

Typically, the enclosure 11 will include a cabinet or body 12, frame 13 and a door assembly 14 hingedly attached to the frame so as to be movable between an unlocked, open position and a locked, closed position secured against the enclosure frame. In the case of a vending machine, as illustrated in FIG. 1, the door assembly typically will include an inner door 16, which typically comprises an insulating barrier formed from an insulating foam material and having an outer frame 17 with a sealing gasket 18 formed from a flexible sealing material applied thereabout, and an outer door 19 which includes an outer frame 21 surrounding a door panel 22 that is formed from a somewhat translucent, durable plastic material such as LEXAN® and typically is imprinted with a design such as a product design or name, or which can be substantially transparent to enable viewing of the product contained within the enclosure. It will also be understood that a single door assembly, comprising a single door with spaced front and rear panels and a door frame, also can be used in place of the multiple door assembly illustrated in FIGS. 1 and 2. Further, in the case of a vending machine, the machine/enclosure generally will include product racks 23 for storing and supporting products P, such as soft drinks or other food items, a motor (not shown) for selecting and dispensing the products, a selector pad assembly S through which users can input desired product selections, and a coin or money reader 24 with a cash box 26 (FIG. 2) for receipt of monies for the selected products. The enclosure also typically will include a machine control 27 (FIG. 1) connected to an external power source, for processing user product requests and controlling the dispensing of products from the machine/enclosure.

The electro-mechanical lock assembly 10 generally includes an electronic lock control system 30 mounted to the outer door 19 and a mechanical locking assembly 31 mounted to the outer door 17 and frame 13 of the enclosure 11, as illustrated in FIGS. 1 and 2, for securing the doors in their locked position against the frame. The electronic lock control system communicates with and actuates or controls the mechanical locking assembly 31 for actuating or disengaging the locking assembly 31 to enable the inner and outer doors to be released and moved from their locked position against the frame 13 to their unlocked, open position for access to the enclosure cabinet.

As illustrated in FIGS. 1–2, the electronic lock control system 30 generally includes an electronic lock controller 35 typically mounted inside the enclosure 11 (FIGS. 1 and 2). The lock controller 35 generally includes a processor or CPU 36 (FIG. 2) such as a 64 to 128 bit microprocessor chip or board having internal memory and a clock, a capacitor 37 for storing power and generating a 40–50 volt DC pulse for activation of an actuator 115 of the locking assembly 31, and a relay 38 for transmitting power to and triggering the actuator. The lock controller generally is not directly connected to a direct power source such as a power outlet as is the machine controller 27 (FIG. 1), but instead is designed to receive and be powered from an indirect power source. The lock controller communicates with the machine controller to transmit program updates and other information to the machine controller and receives data or information from the machine controller as to the operation of the enclosure such as a vending machine.

A further embodiment of the electronic lock control system of the electro-mechanical locking apparatus for controlling the actuation of the mechanical locking assembly is schematically illustrated in FIG. 3. This additional embodiment of the electronic control system, indicated generally by 30', generally includes an electronic controller 39 similar to the lock controller 35 (FIG. 2), as discussed above, for controlling the actuation and disengagement of the mechanical lock assembly 31. The lock controller 39 (FIG. 3) includes a CPU or processor 40, which typically is a 16 to 128 bit microprocessor chip or board having internal memory and an internal clock. In this embodiment, the lock controller further is connected to a direct, constant power source, indicated in 41A, such as the power source for the vending machine or enclosure being secured with the electro-mechanical lock assembly. In addition, a back-up battery 41B generally is provided for the lock controller, and typically comprises an approximately 12 volt, 1.5–2 amp battery, which provides back-up power to the lock controller 39 in the event that the direct power supply 41A is interrupted.

The lock controller 39 further includes a capacitor 42 and a relay 43 for transmitting a power signal or pulse to the actuator of the mechanical lock assembly 31. An electronic access device 44 generally is mounted to the front of the door assembly for the machine/enclosure and is connected to the lock controller 39. The electronic access device generally can include a variety of different types of access devices such as card swipe readers, proximity card readers which read an access card carried by the operator or service technician, a touch or key pad in which an access code generally is entered by the service technician or operator, a receiver unit which can receive signals, including access information, from a remote control unit carried by the service technician or operator, or a key assembly which sends an access control signal to the processor 40 of the lock controller 39 when a key is inserted and turned to indicate that the machine or enclosure has been accessed for disengaging the mechanical lock assembly to enable opening of the machine/enclosure.

A data/power link 45 is connected to the lock controller for supplying power and control signal/instructions to and transmitting data from the lock controller. The data/power link generally includes an inductive coupling 46 such as a ferrite coil, typically 40–50 mm in diameter by approximately 25–30 mm in thickness, such as manufactured by MAGNETICS®. In addition, the data/power link includes a transceiver for receiving and sending data signals by electromagnetic dynamics or could include a radio frequency (RF) link or transceiver, or an infrared link, primarily for use with a substantially transparent outer door panel. The data/power link is mounted on the rear surface of the outer door 19 as shown in FIG. 1, typically positioned in the upper left hand corner adjacent the door frame 21, and facing outwardly so as to position the data/power link in a fixed location for ease of locating. The data/power link 45 generally includes two sets of leads 47 and 48 that are connected to the lock controller 35. One set of leads 47 transmits power received through the data/power link to the lock controller, while the other set of leads 48 transits data received through the data/power link to the lock controller.

A key controller or data transmitter 50 is provided for inductively transmitting power and control instructions or signals through the door(s) of the enclosure to the lock controller via the data/power link and for receiving data and operational information from the lock controller. In a first embodiment, shown in FIG. 4A, the key controller 50 typically is a hand held unit which includes a housing 51, a processor chip 52 such as a 16 to 128 bit microprocessor, a power source 53 such as a 9–12 volt battery that typically is rechargable or which enables a connection to an AC outlet or other external power source, a switch 54, and an inductive coupling or link 56 that matches the inductive coupling of the data/power link. For example, if the data/power link includes a ferrite coil inductive coupling 46, the key controller typically will include a matching ferrite coil. The key controller is aligned with the data/power link and transmits power inductively through the front panel of the outer door of the enclosure through inductive transfer to the data/power link and thus to the lock controller. Thereafter, once the data/power link has been energized by the inductive power transfer, data is transferred between the key controller and data/power link through electromagnetic dynamics, or, if an RF or infrared link is used, through radio frequency or infrared signals, to indirectly power and communicate with and/or program the lock controller.

Figure 4A:
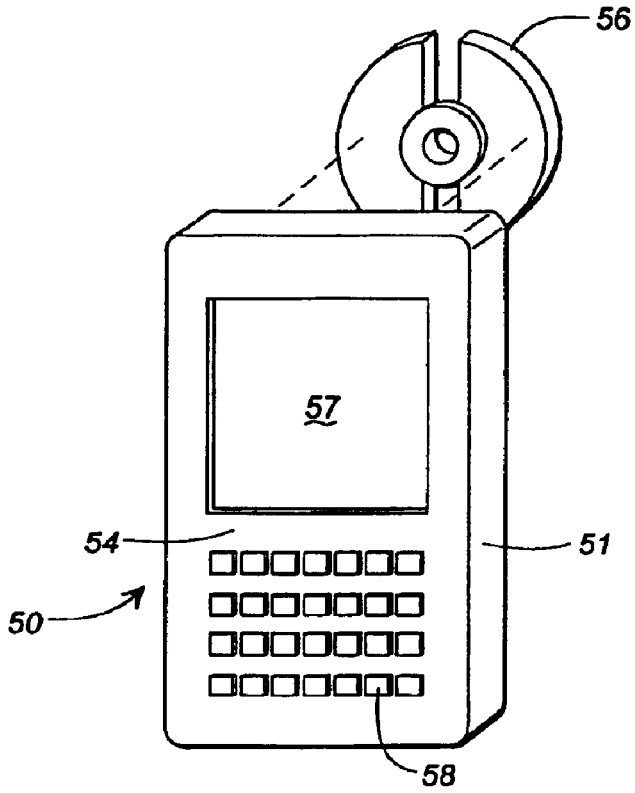
FIG. 4A is a perspective illustration of a first embodiment of the key controller.
Figure 4B:
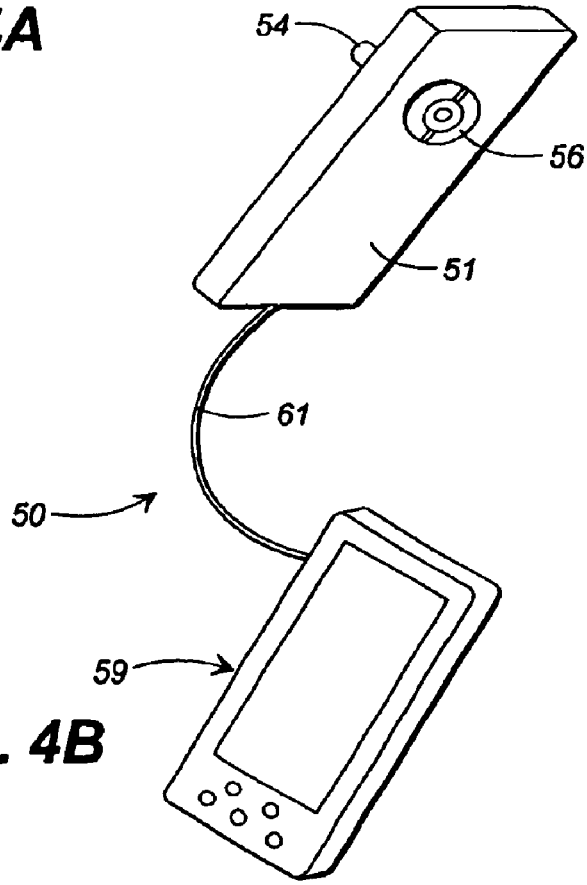
FIG. 4B is a perspective illustration illustrating a second embodiment of the key controller.

As illustrated in FIGS. 1 and 4A, the key controller further includes a display 57 through which programming and data/information received from the lock controller can be reviewed by an operator. The key controller also generally includes an input mechanism such as a key pad 58 (FIG. 4A)

or can use a touch screen for the display 57. In an additional embodiment as illustrated in FIG. 4B, the key controller 50' also can comprise a hand held PC, such as a PALM PILOT® or similar hand held personal computing unit, used in place of the touch screen and key pad for the controller 59 and connected to the key controller 50' by a lead or connection 61.

Figure 5A:
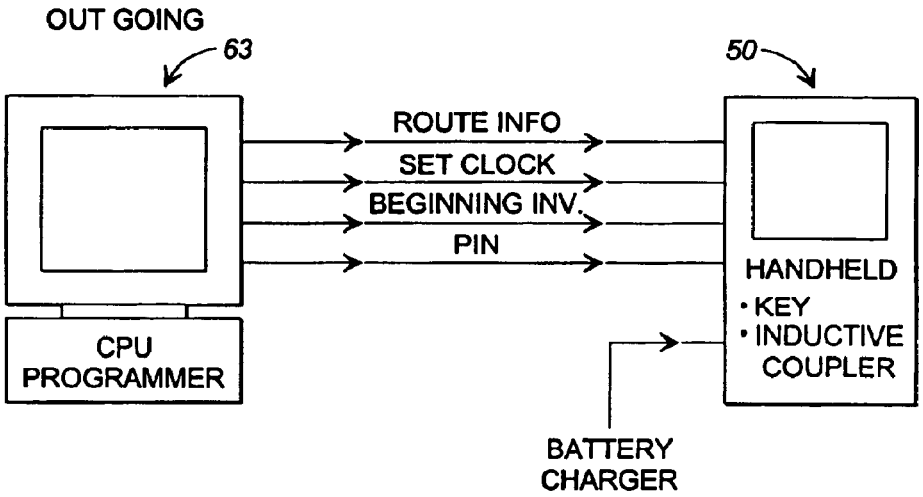
FIG. 5A is a schematic illustration of the programming of the key controller.
Figure 5B:
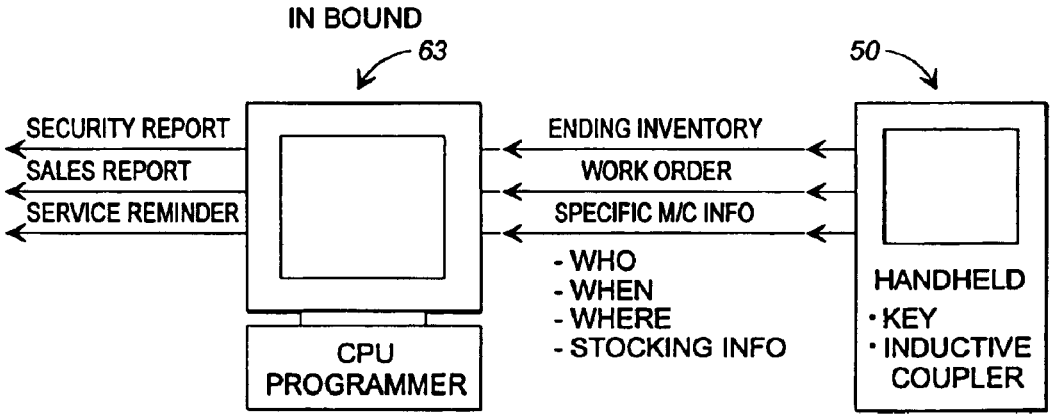
FIG. 5B is a schematic illustration of the downloading of information from the key controller to a central processor or server for the preparation of reports.

The hand-held key controller unit typically is programmed through a central processing unit or server computer 63 (FIG. 5A) at the operator's base of operations. The key controller is typically programmed with data/information such as route information and a personal identification number or code that can be set to authorize access to only certain types or groups of vending machines, and its internal clock is set to match the internal clock of the lock controller of the machines/enclosures to be accessed by the key controller as indicated in FIG. 5A. In addition, the key controller typically is programmed with program instructions for downloading to the lock and machine controllers during accessing of the lock controllers. For example, program instructions can be included in the key controller to set operating times for a vending machine such that the machine will only allow access and operation for dispensing products during a certain prescribed time interval such as during school lunch hours for vending machines located at school cafeterias. The internal power source, i.e., battery, of the key controller also is typically fully charged and can be reprogrammed on a regular basis such as on a daily or weekly basis as needed. As indicated in FIG. 5B information received and stored in the key controller from the machines accessed thereby also generally will be downloaded to the server 63 from the key controller for generating reports and monitoring the servicing of the machines.

In addition, a secondary or back door control access 65 typically is provided adjacent a lower edge of the door assembly. The secondary or back door control access generally includes a pair of connectors 66 (FIG. 1) mounted to the outer door 19 of the door assembly 14 and which are connected to the lock controller via leads 67. The connectors typically are female connectors that receive mating male connector leads 68 from a spare inductive coil or power link 69 as illustrated in FIG. 2 to transmit power to the key controller and to the lock controller 35. If the primary data/power link 45 malfunctions or becomes disengaged from the inner door and thus it is not possible to transmit power and data signals to the lock controller through data/power link 45, the spare power link can be connected to the lock controller via the connectors and leads of the secondary or back door control access to providing power to the lock controller for actuation of the solenoid of the mechanical locking assembly to cause the release of the mechanical locking assembly and enable opening of the door assembly for the enclosure.

Figure 6A:
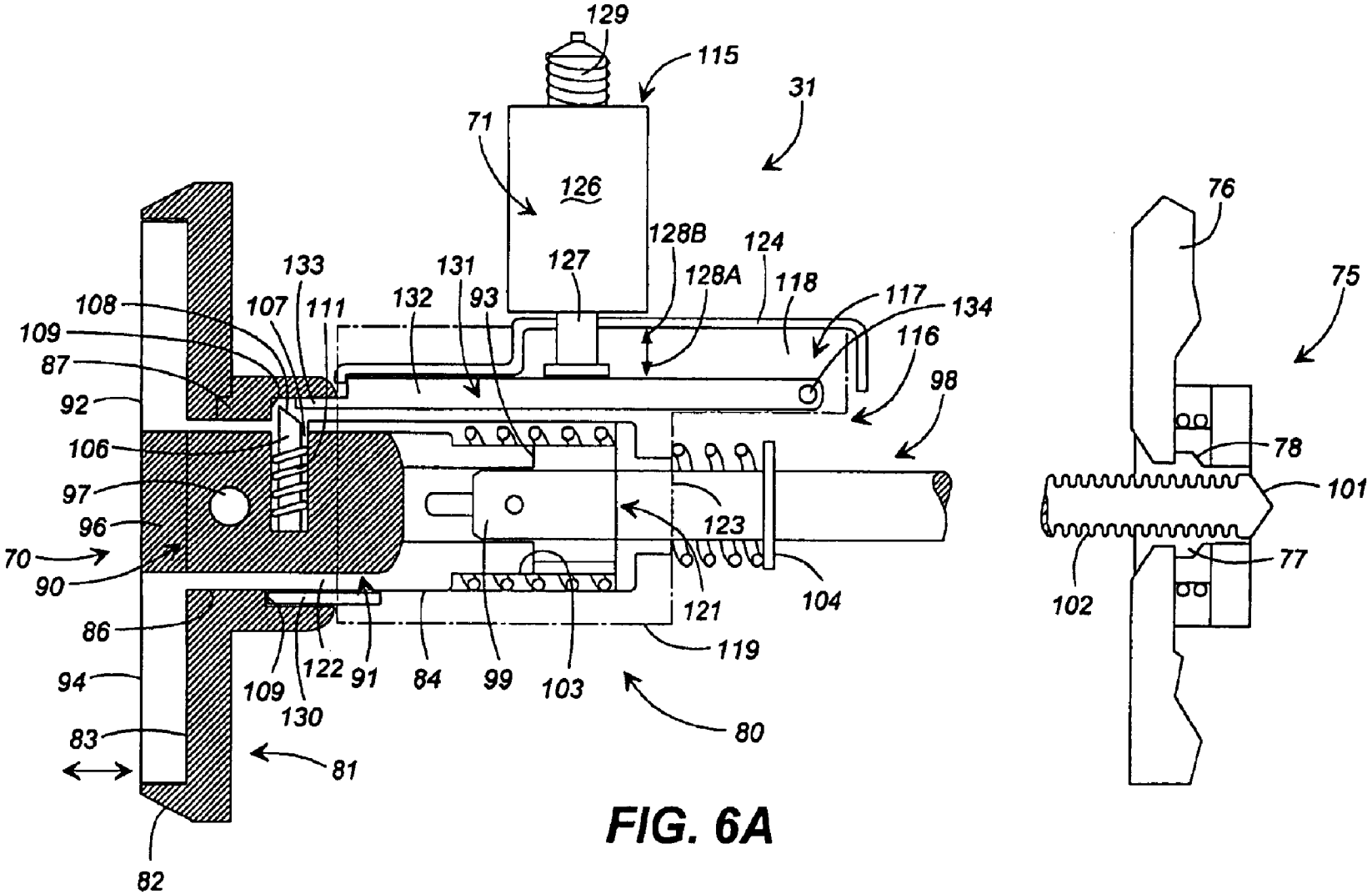
FIG. 6A is a side elevational view of a first embodiment of the mechanical locking assembly with solenoid actuator for use as part of the electro-mechanical lock assembly.
Figure 6B:
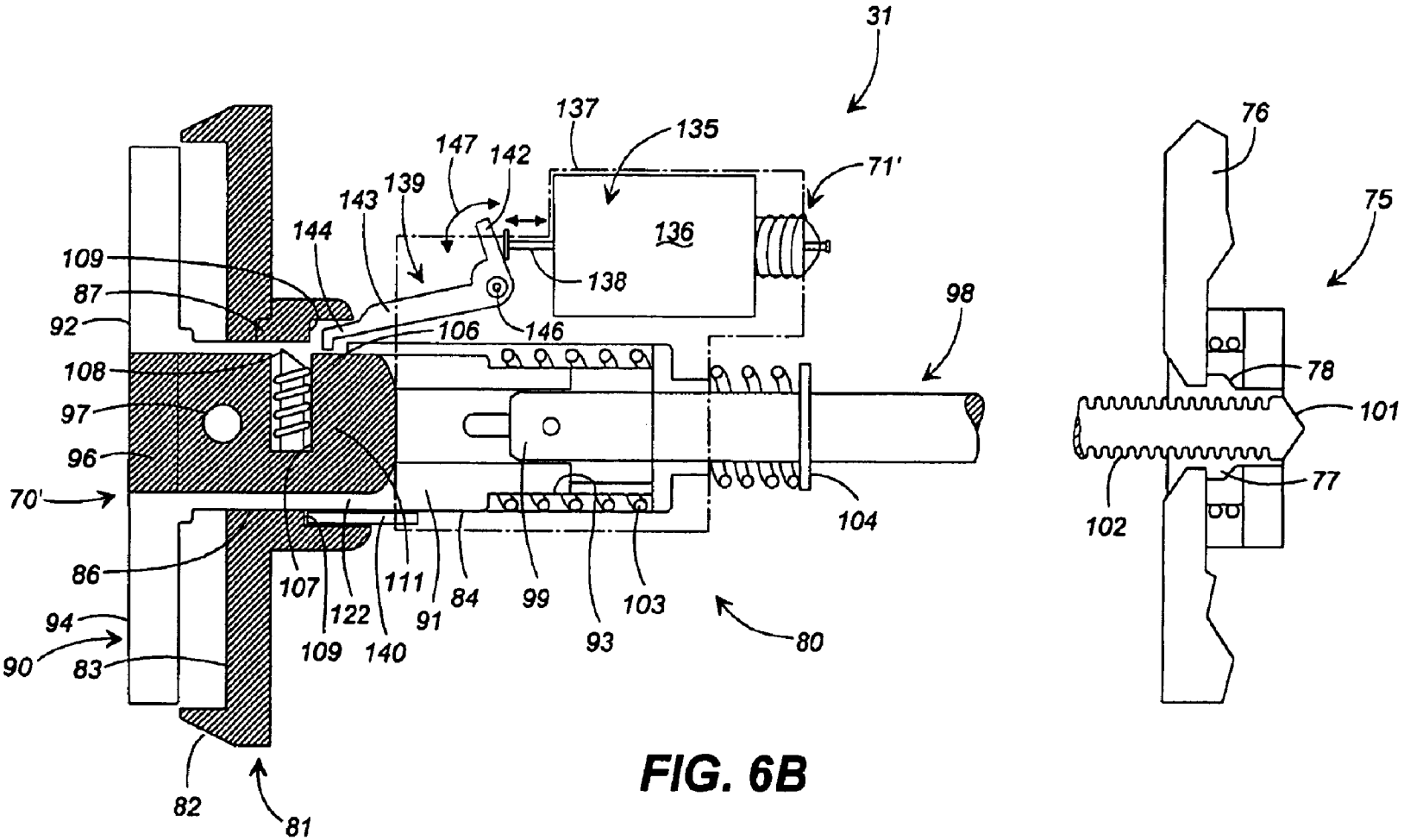
FIG. 6B is a side elevational view of a second embodiment of the mechanical locking assembly with solenoid actuator for use as part of the electro-mechanical lock assembly.
Figure 6C:
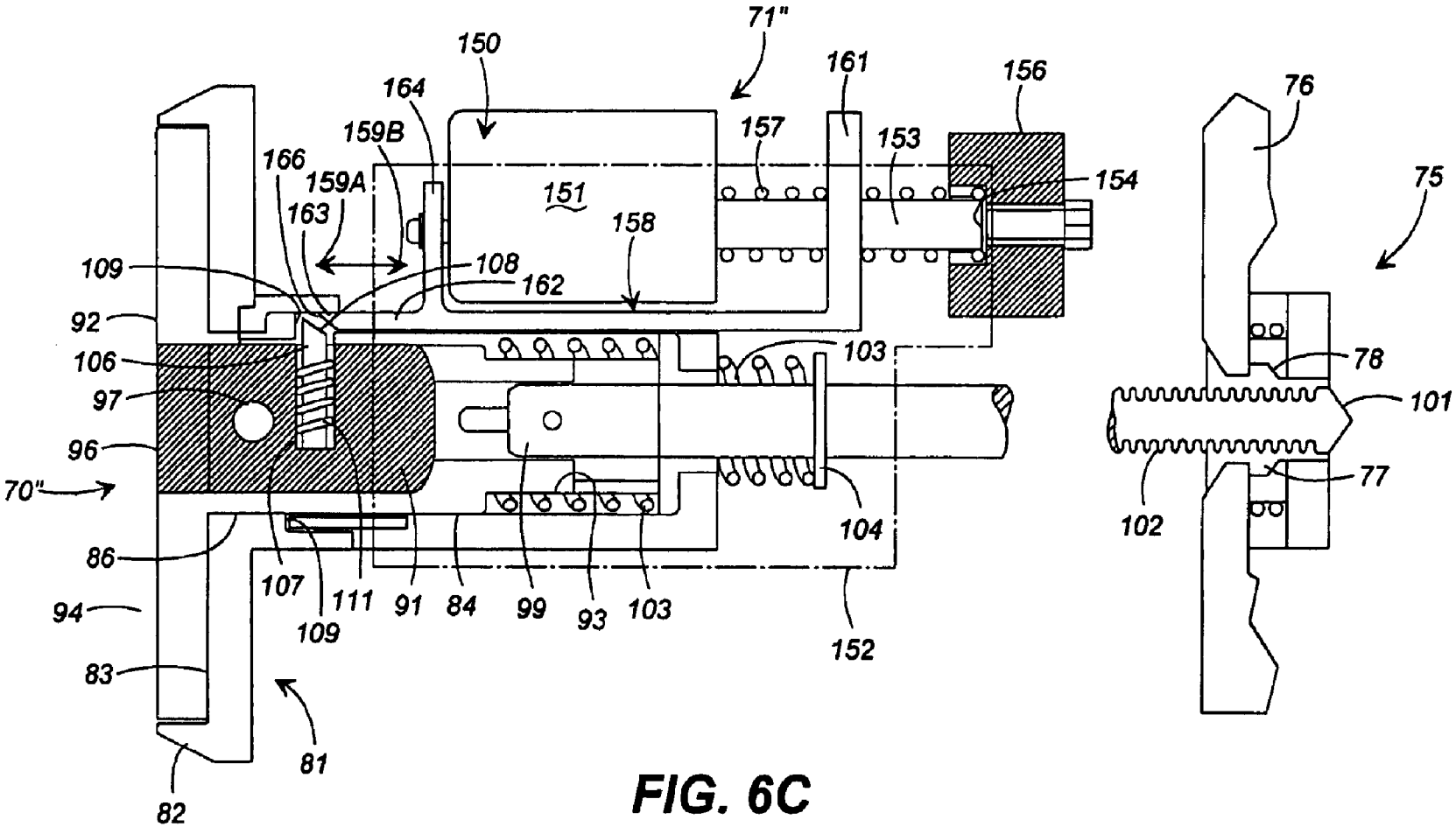
FIG. 6C is a side elevational view of a third embodiment of the mechanical locking assembly with solenoid actuator for use as part of the electro-mechanical lock assembly.

The mechanical locking assembly generally 31 can include a conventional T-handle assembly, as illustrated in FIGS. 6A–6C, or can include a post locking system or other similar types of mechanical locking or locking apparatus as conventionally known and used with vending machines and similar types of enclosures. FIGS. 6A–6C illustrate various embodiments of the T-handle locking assembly 70 (FIG. 6A) 70' (FIG. 6B) and 70" (FIG. 6C) for use in the electro-mechanical lock release assembly 10 (FIGS. 1 and 2) of the present invention, for securing the door of the enclosure when locked and which is generally disengaged by a lock release mechanism 71 (FIG. 6A), 71' (FIG. 6B) or 71" (FIG. 6C) actuated by the lock controller 30 (FIG. 2).

As illustrated in FIGS. 6A–6C, the mechanical locking assembly 31 includes a first or inner lock housing 75 mounted to the frame 13 of the enclosure and including a mounting plate 76 that is secured to the enclosure frame. An axial passage 77 is formed through the mounting plate and a series of lock elements 78 are positioned along and project into the axial passage. A post assembly 80 is mounted to the outer door 19 (FIG. 1) opposite the first or inner lock housing 75 in a position to engage the inner lock housing when the inner and outer doors are moved to their closed position against the enclosure frame. The post assembly 80 generally includes an outer lock housing 81 mounted to the outer door 19 of the enclosure 11 (FIG. 1) and projecting therethrough. The outer housing generally includes a front plate 82 having a recessed area 83 formed therein. An open ended cavity or passage 84 is formed within the outer lock housing and includes a first open end 86 formed in the front plate 82 and a second open end 87 having a narrowed diameter formed at the rear end of the outer lock housing 81 as shown in FIGS. 6A–6C.

A handle assembly 90 is received within the open cavity 84 of the outer lock housing 81. The handle assembly can be formed using an existing conventional T-handle assembly 70 for a vending machine or enclosure, including a handle body 91 having a first or front end 92 and a second or rear end 93 and which is received within and extends along the opened ended cavity 84 and through a lock opening 95 (FIG. 1) formed in the inner door 16, and a grip portion 94 (FIG. 6A) formed at the front end 92 of the handle body for enabling the handle body to be gripped and rotated by a user. With the present invention, the key lock generally used with conventional T-handle locking assemblies generally is removed and a substantially solid plug or core 96 is inserted into the handle body in place of the lock. As FIG. 6A illustrates, the plug typically further includes anti-drill pins 97 positioned vertically and horizontally to prevent vandals, thieves, etc. from drilling through the handle body to break or disengage the mechanical lock assembly.

An elongated post or shaft 98 is mounted to the rear end 93 of the handle body 91 and projects through the second open end 81 of the outer lock housing 81 and is received through the opening 90 (FIG. 1) in the inner door. The post generally includes a proximal or first end 99 (FIGS. 6A–6C) that is slidably mounted to the second end 93 of the handle body 91 so that the post is longitudinally movable with respect to the handle body, and a second or distal end 101 that extends away from the outer lock housing. A series of teeth or threads 102 are formed about the distal end 101 of the post 98 and engage the lock elements 78 of the inner lock housing 75 as the post is received within and rotated about the axial passage 77 thereof so as to lock the post within the axial passage to lock and secure the inner and outer doors against the enclosure frame. The post can also be formed as a threaded rod as understood in the art.

A compression spring 103 or similar biasing element, is received about the proximal end 99 of the post 98, positioned within the open cavity 84 of the outer lock housing. The compression spring is engaged between the rear end 93 of the handle body and a thrust washer 104 mounted about the post 98 as illustrated in FIGS. 6A–6C.

The spring tends to urge the handle body longitudinally out of the outer lock housing to maintain the handle body in an extended, nonengaging, unlocked position until the post has been fully secured within the inner lock housing and the handle is depressed into and engaging, locked position with the grip portion 94 of the handle assembly being received within the recessed area 83 of the outer lock housing.

A locking element or bolt 106 is positioned along the handle body and projects upwardly therefrom through an opening 107 formed in the handle body. The locking bolt generally is formed from a metal such as steel and includes an upper end 108 having a beveled or sloped portion 109 adapted to engage the upper edge of the open ended cavity of the outer lock housing as the handle body is moved therealong. A biasing element 111 such as a compression spring is positioned adjacent or received about the locking bolt and urges the locking bolt upwardly toward a raised, engaging position extending through the opening 107 formed in the handle body as illustrated in FIG. 6A. With the locking bolt 106 in its raised position extending through opening 107 and engaged against a distal surface 108 formed in the outer lock housing, the handle body is locked in its housing recess 109, engaging position against the outer door of the enclosure.

As illustrated in FIG. 6A, in a first embodiment of the T-handle assembly 70, the release mechanism 71 includes an actuator 115 mounted on the mechanical locking assembly adjacent the outer lock housing for disengaging the locking bolt 106 from the outer lock housing recess 109 to release the handle body to enable operation/rotation of the handle assembly for unlocking of the doors. The actuator 115 typically is mounted on a support or mounting saddle 116 (indicated by phantom lines) that is generally formed from a rigid, durable material such as a metal, such as steel or aluminum, or a plastic material. The saddle 116 generally has a substantially U-shaped body 117 with upstanding, spaced parallel side walls 118 and a bottom wall 119 defining a substantially U-shaped recess 121 with open front and rear ends 122 and 123, respectively, in which the mechanical locking assembly 31 is received as shown in FIG. 6A. A cover or upper support plate 124 is mounted on the upper ends of the side walls 118 and supports the actuator in a position for engaging and actuating the mechanical lock assembly.

The actuator 115 generally include a solenoid 126, typically a 12 to 24 volt solenoid having an approximately 1.0 ohm resistance, having a plunger 127 that is extended and retracted in the direction of arrows 128A and 128B by the solenoid upon actuation and deactivation of the solenoid. As indicated in FIG. 6A, the plunger generally extends through the housing and engages a spring 129 that tends to bias the plunger rearwardly beyond a retracted, non-engaging position. A release element 131, such as a pivoting arm or bar 132, is pivotally mounted to the support saddle 116 and includes a release portion 133 that engages the upper end 108 of the locking bolt 106 as the arm 132 pivots about pivot pin 134 downwardly into a release position.

A gauging element 130 is removably received on the saddle 116 and engages the lower portion of the outer lock housing. The gauging element 130 generally is formed from a resilient material such as a metal or plastic and acts as a gauge or guide for positioning the saddle and the release element 131 at the proper level for engaging the locking bolt 106. The gauging element 130 further acts to obstruct the locking bolt of the T-handle as the T-handle is received within the lock housing to guard against the locking bolt from engaging in the wrong position so as to fail to properly and completely secure the door of the enclosure. The gauging element also can be removed from the saddle for use with new design T-handle locking assemblies that restrict the handle to only one locking position.

As the solenoid is actuated, the plunger 127 is extended and causes the arm 132 to pivot downwardly about the pivot pin 134 so that its release portion or projection 133 engages and urges the locking bolt 106 downwardly through the opening 107 formed in the handle body so as to move the locking bolt out of its engaging position to release the handle assembly from the outer lock housing. Once the locking bolt has been moved out of engagement with the outer lock housing, the compression spring 103 within the open ended cavity of the outer lock housing urges the handle body outwardly so as to move the grip portion of the handle assembly out of the recessed area 83 of the outer lock housing to enable the handle assembly to be gripped and rotated for rotation of the post to remove the post from locking engagement with the retention element. As the distal end of the post is disengaged from the axial passage of the inner lock housing, the inner and outer doors are released from their locked, engaging position against the enclosure frame and thereafter can be moved to their open position displaced from the enclosure frame to enable access to the interior cabinet of the enclosure.

FIG. 6B illustrates a further embodiment of the T-handle assembly 70' of the mechanical locking assembly 31, in which the release mechanism 71' includes an actuator 135, such as a 12 to 24 volt solenoid 136 having an approximately 1.0 ohm resistance, supported in an operative position adjacent the T-handle assembly 70' by a support or mounting saddle 137 (shown in phantom lines). The support saddle 137 is similar to saddle 116 (FIG. 6A) discussed above, and includes a removable gauging element 140 for positioning the saddle and actuator at the proper height and preventing the engagement of the locking bolt in a position other than the desired locking position.

The solenoid 136 (FIG. 6B) generally includes an extensible plunger 138 that is extended and retracted from the solenoid as indicated in FIG. 6B. A release element 139 is pivotally attached to the support saddle in front of the plunger so as to be engaged and moved by the extension and retraction of the plunger. In this embodiment, the release element 139 generally is illustrated as a pivotable substantially L-shaped arm having a vertically extending rear end or portion 142 that can be attached to or can simply be engaged by the rear end of the plunger, a forward portion 143 having a beveled front end for engaging the locking bolt 106 of the handle assembly, and a pivot/hinge pin 146 for pivotally attaching the release element to the support saddle 137. The front end 144 of the release element 139 engages and urges the upper end 108 of the locking bolt 106 downwardly as the release element is pivoted in the direction of arrow 147 upon the extension of the plunger 137. As a result, the locking bolt is urged downwardly recess 109 through the opening 107 into a release position out of engaging contact with the outer lock housing so as to release the handle assembly of the T-handle 70' from the outer lock housing to enable rotation of the handle assembly and thus the post, to remove the post from locking engagement with the axial passage of the interlock housing. This enables the release and movement of the inner and outer doors from their locked, engaging position against the enclosure frame, to their open position displaced from the enclosure frame to enable access to the interior cabinet.

A third embodiment of the release mechanism 71" for use in an additional embodiment 70" of the T-handle assembly is illustrated in FIG. 6C. In this embodiment, the release mechanism 71" includes an actuator 150, such as a 12 to 24 volt approximately 1.0 ohm resistance solenoid 151 mounted above the T-handle assembly as shown in FIG. 6C. The actuator 150 is mounted on a support saddle 152 (shown in phantom lines) having a removable gauging element releasibly mounted thereto. The solenoid 151 generally includes a plunger 153 having a distal end 154 displaced from the solenoid, and which is received and held within a mounting block 156. A tension spring 157 is positioned about the plunger 153 and is secured at one end within the mounting block 156. A release element 158 is slidably mounted on the plunger so as to be movable in the direction of arrows 159A and 159B upon actuation and movement of the solenoid in the direction of arrows 159A and 159B.

The release element generally includes a substantially U-shaped slide member having a first or rear end 161 formed as a vertically extending, upstanding bar or plate that is received over and slides along the plunger 153 as indicated in FIG. 6C, and a second end 162 having a front edge 163. The bar 161 further is engaged by and generally is urged rearwardly in the direction of arrow 159' by the tension spring 158, which tends to urge the solenoid and the release element rearwardly toward a nonengaging locking position. A connector piece 164 is generally formed intermediate the first and second ends 161 and 162 of the release mechanism, and generally includes a vertically extending flange or projection adjacent the forward-most end of the solenoid and typically mounted to the solenoid by a fastener.

As the solenoid is moved in the direction of arrow 159A upon actuation and thereafter in the direction of arrow 159B by the force of the tension spring, the release mechanism likewise is moved in the direction of arrows 159A and 159B between an engaging, release position, and a non-engaging, locking position. As illustrated in FIG. 6C, the front end 163 of the release element, generally is formed with a beveled front edge 166 to engage and progressively urge the top edge 108 of the locking bolt or element 106 as the release element is moved in the direction of arrow 159A upon actuation of the solenoid. As a result, the locking element or bolt 106 is urged downwardly toward an unlocked, non-engaging position to enable release of the handle assembly as illustrated in FIG. 6C. Once so released, the handle assembly, and thus the post can be rotated to cause the post to be released from the interlock housing and enable the unlocking and thus the opening of the inner and outer doors of the enclosure to enable access to the inner cabinet.

OPERATION

Figure 7:
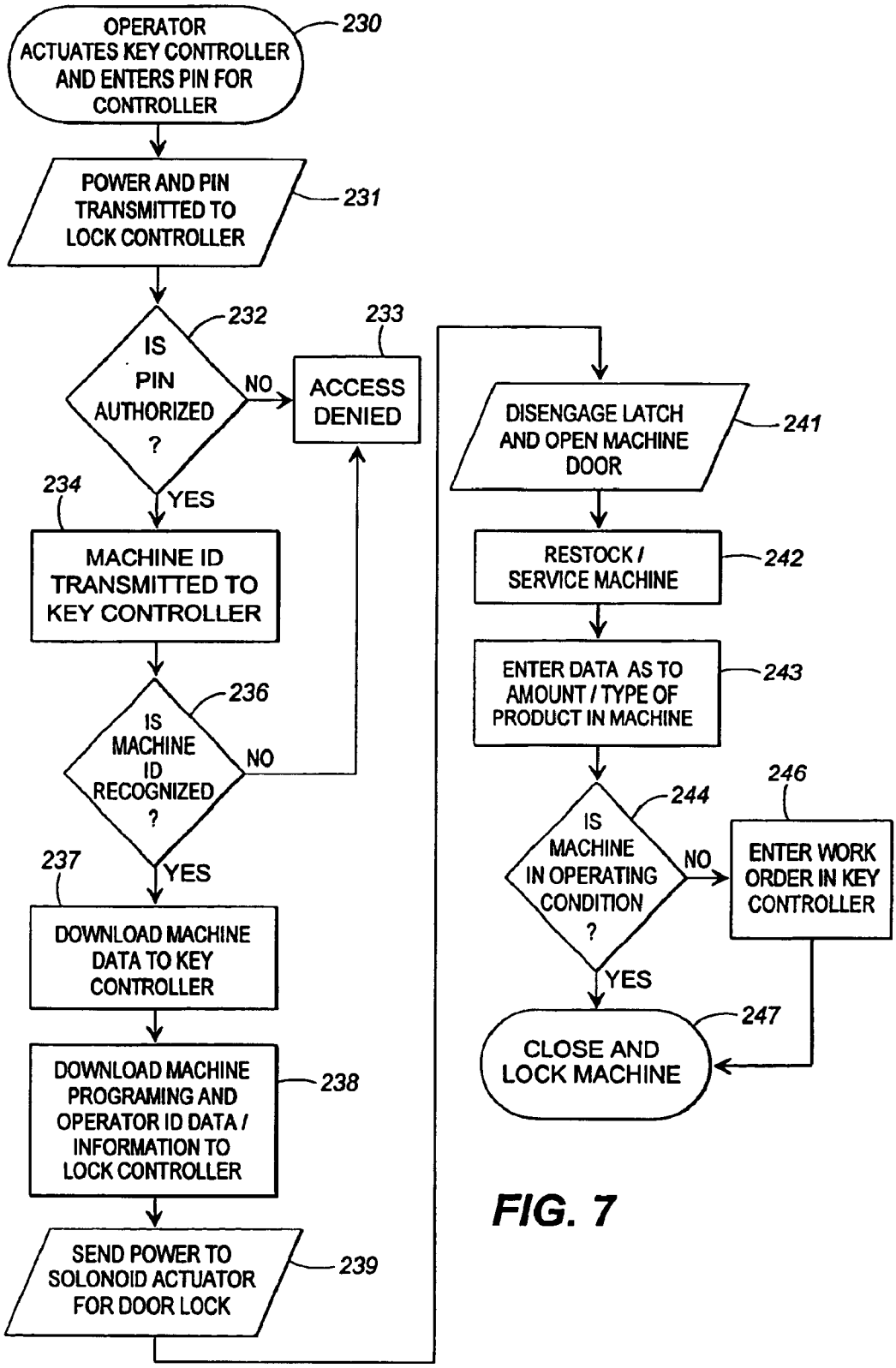
FIG. 7 is a flow chart illustrating the operation of the electro-mechanical lock assembly of the present invention.

The operation of the electronically operated locking assembly 10 is generally illustrated in FIGS. 1 and 7. As shown in FIG. 5A, prior to use, the key controller is initially programmed from a central processor or server computer 63 with information including route information identifying a particular set of machines to be accessed by the key controller, identifying the beginning inventory of products being sent out with the service technician or operator, setting the clock within the key controller, to match that of the lock controllers of the machines to be accessed and programming the key controller with a personal identification number (PIN) for accessing the desired machines. In addition, any necessary programming updates for the machines to be accessed also generally are programmed into the key controller. The battery or other power source of the key controller further is fully charged as illustrated in FIG. 5A. Once the key controller 50 has been fully programmed and its battery charged, the user or service technician is able to access a desired series of machines or enclosures for restocking and servicing.

As illustrated in FIG. 1, for operation of the electronically operated locking assembly for opening a desired machine or enclosure, the user first places the key controller on the outer door 19 of the door assembly 14 of the enclosure 11 in registry with the data/power link 45 mounted to the rear surface of the panel 22 of the outer door 19 adjacent a corner of the frame 17 of outer door 19. Typically, the data/power link will be positioned at a corner of the door frame so that the key controller can be slid into the corner and into engagement with the outer door frame 21 to automatically locate and place the inductive coupling or link of the key controller 50 in registry with the inductive coupling of the data/power link 45. It is also possible to provide indicators on the front panel 22 of the outer door 19 for aiding the locating of the key controller in registry with the data/power link and allow the data/power link to be positioned at various points about the inner door as desired. Once the key controller is properly positioned opposite the data/power link 45, the operator, such as a service technician or "route-man", can initiate an opening or unlocking operation as illustration in FIG. 7.

As shown in FIG. 7, as a first operational step 230, the operator actuates the key controller by closing the switch 54 (FIG. 2) and, if necessary, enters the personal identification number for the controller through the key pad and display 58 and 57 (FIG. 4A). Upon actuation of the key controller, power from the battery of the key controller is transmitted inductively through the door across an air gap to the mating data/power link and to the lock controller to energize the data/power link and lock controller, after which the PIN of the key controller is transmitted through the data/power link to the lock controller as illustrated in step 231 (FIG. 7). The lock controller in step 232 checks the PIN number of the key controller against a programmed list or set of authorized PIN numbers stored within the memory of the lock controller. If the PIN number is not found to be an authorized identification number, access is denied as indicated at 233. If the PIN number is recognized as being an authorized identification number, the particular machine identification is transmitted to the key controller as indicated at 234. The key controller then checks to see if the machine is a recognized machine that is to be accessed during this particular service call by the key controller, as illustrated at 236 and if not, access to the machine is denied.

If the machine ID is recognized as a machine that is to be accessed during the particular service call, a response signal is sent to the lock controller verifying the machine ID and in turn the lock controller downloads data concerning the operation of the machine, such as the time and dates that the machine has been accessed and by whom as well as potential fault conditions detected by the machine controller as shown in step 237. Thereafter, in step 238 the key controller downloads machine programming and operator identification data and information to the lock controller to provide programming updates to the machine and create a record of the date, time and by whom the machine has been accessed. After the transfer of machine data and programming and operation identification data between the key controller and lock controller, the lock controller sends an approximately 40 to 50 volt signal or power pulse, as indicated at step 239, to the solenoid for the mechanical locking assembly. This power signal causes the plunger 127 (FIG. 6A), 138 (FIG. 6B) or 153 (FIG. 6C) of the solenoid to be extended and engage and pivot or move the release element 129 (FIG. 6A), 139 (FIG. 6B) or 138 (FIG. 6C).

It is also possible to replace the key/data transmitter with a more conventional signaling or activating mechanism, such as a keypad, card reader or scanner, keyed switch or other type of input mechanism, for providing a control command or signal to the lock controller for activating the lock controller to engage/disengage the solenoid. With such a construction, upon receiving a command or control signal from the signaling mechanism, the lock controller sends the power signal or pulse to activate the solenoid. The solenoid thus extends or retracts its plunger to engage and pivot or move the release element into engagement with the locking bolt.

The pivoting and engagement of the release element with the locking bolt causes the locking bolt 106 to be urged downwardly against the force of the biasing element or spring 111 so as to release the handle assembly from its engaged, locked position within the recess 109 of the outer lock housing 81. In response, the handle body and grip portion 94 are urged outwardly away from the outer lock housing and front surface of the outer door by the compression spring 103 bearing against the second or rear end 93 of the handle body 91 to place the grip and handle body in an extended, nonengaging position displaced from the outer lock housing and front surface of the outer door to enable rotation of the handle body. The operator then rotates the handle body to disengage the distal end 101 of the post 98 from the lock elements 78 of the first or inner lock housing 75 to thus disengage the lock assembly and enable the machine doors to be opened as indicated at 241 (FIG. 7). If a post type locking assembly is used, typically the locking element will be mounted in the inner lock housing and will be disengaged from the post by actuation of the solenoid so that the post is released from engagement with the inner lock housing to allow the door to be opened without requiring further manipulation or rotation by the operator.

Once the machine doors have been opened, the operator can restock the machine as indicated at 242 or perform any needed servicing of the machine components. As indicated at 243, the operator thereafter enters data into the key controller as to the types and amount of product stocked in the machine so as to provide a record of how much product was previously used or dispensed by the machine to check against the machine receipts and for inventory control. As shown at 244, the operator further checks to see if the machine is in operating condition, and if not, he or she enters a work or repair order, shown at 246 to the key controller. After the work order has been entered into the key controller or if no repair/work order is required, the operator closes the doors and re-engages the mechanical locking assembly as a final step 247.

After the operator has completed all of his service calls for the day, week or other time period, the information recorded in the hand held key controller from each machine services by the operator is downloaded to the central processor or server unit 63 as indicated at FIG. 5B. For example, information as to the machines serviced and the amount of inventory dispensed into each machine is downloaded to the central computer unit and can be checked against the beginning and ending inventory sent out with that particular operator. In addition, any work or repair orders and machine specific information, such as who had accessed the machines, when such access was made, as well as information regarding how long each service call took for a particular machine or set of machines also can be downloaded and reported. This information in turn can be used to run reports such as security, sales and/or service reports to enable closer monitoring and more detailed information to be generated regarding how much product is being dispensed from certain machines or groups of machines so as to indicate the frequency at which such machines need to be serviced and average service times for such machines for better or more efficient planning of service routes and calls.

The present invention thus provides more enhanced security of enclosures such as vending machines, ATMs or similar types of enclosures by providing an electronically operated locking assembly through which access to the machines/enclosures can be tightly controlled, and which further enables information regarding the servicing of such machines/enclosures to be monitored and reported to enable businesses to service such machines/enclosures more efficiently and to reduce or minimize down time and losses.

It will be understood by those skilled in the art that while the foregoing invention has been disclosed with reference to preferred embodiments or features, various modifications, changes and additions can be made to the foregoing invention, without departing from the spirit and scope of the invention as set forth in the following claims.

I claim:

1. An electronic lock release for unlocking a door of an enclosure, comprising:

a locking assembly including a post, a T-handle for rotating said post, a lock housing defining a longitudinal passage adapted to receive a portion of said post therethrough, and a locking element housed in said T-handle and movable into locking engagement with said lock housing for securing the door in a locked position;

a release mechanism mounted adjacent said locking assembly for disengaging said locking element from locking engagement within said housing to enable said T-handle to rotate said post within said lock housing to open the locked enclosure;

wherein said release mechanism includes:

a lock controller including an actuator automatically actuatable in response to a control signal for controlling the release of said locking element to permit rotation of said post within said lock housing, a key controller remotely transmitting the control signal indirectly through the enclosure to said lock controller, and a release element positioned adjacent said locking assembly and moveable between an engaging position and a non-engaging position by said actuator for disengaging said locking element of said locking housing to permit rotation of said post to unlock the door of the enclosure.

2. The lock release apparatus of claim 1 and wherein said actuator includes a solenoid having a plunger element that is moved in response to actuation of said solenoid to cause said release element to be moved from its engaging position to its nonengaging position to disengage said locking element from said post.

3. The lock release apparatus of claim 1 and further comprising an RF data link, and wherein said key controller includes a hand held RF transmitter for transmitting an RF pulse signal containing control signals across a desired distance to said RF data link, and a power source for powering said key controller.

4. The lock release apparatus of claim 1 and further comprising an infrared link and wherein said key controller includes an infrared transceiver for communicating with said infrared link.

5. The lock release apparatus of claim 1 wherein said lock controller and said key controller include software for recording access information transmitted in response to actuation of said lock controller and for restricting access to the enclosure upon receipt of nonconforming access information.

6. The lock release apparatus of claim 5, wherein said software records the nonconforming access information.

7. The lock release apparatus of claim 1 and wherein said release mechanism further includes a support saddle received about said post and said lock housing and to which said release element is movably mounted for engaging said locking element.

8. The lock release apparatus of claim 7 and fisher including a gauging element mounted to said support saddle for positioning said release mechanism to engage said locking bolt.

9. A lock release apparatus for securing a door to a door frame of an enclosure, comprising:

a lock assembly having a post, a T-handle rotatably mounted to the door and having a locking element movable between a locking position and an unlocking position, and a lock housing mounted to the door frame and positioned to support said post therethrough whereby said locking element is urged into engagement with said lock housing to obstruct post rotation and to secure the door to the door frame in a locked position;

an electronic lock control system including an actuator for causing said locking element to be released and enable said post to be rotated in said lock housing and a key controller capable of remotely communicating with said lock controller for transmitting a control signal indirectly through the enclosure to said lock controller; and a lock release mechanism mounted adjacent said lock assembly and having a release element adapted to engage and urge said locking element into a release position disengaged from said lock housing upon actuation of said actuator.

10. The locking apparatus of claim 9 and further comprising a data/power link comprising an inductive coupling.

11. The locking apparatus of claim 9 and wherein said lock controller comprises a processor and a capacitor for disengaging said lock assembly.

12. The locking apparatus of claim 9 and wherein said lock assembly comprises a T-handle lock and a second lock housing, mounted within the enclosure and wherein said post includes a distal portion having a first end adapted to engage said second lock housing in locking engagement to secure the door in a locked position against the frame of the enclosure and a second spaced from said first end, and a proximal portion slidably received within said second end of said distal portion and having a handle mounted thereto for rotating said post to disengage said post from the second lock housing.

13. A method of unlocking a door releasibly secured to a frame of an enclosure, comprising:

remotely transmitting a control command from a key controller indirectly through the enclosure to a lock controller;

energizing an actuator for a locking assembly for the door;

as the actuator is energized, moving a release element positioned adjacent the locking assembly into engagement with a locking element of the locking assembly;

moving the locking element to an unlocked position with the release element, disengaged from a lock housing mounted to the frame of the enclosure; and disengaging the locking assembly and opening the door of the enclosure.

14. The method of claim 13 and wherein the step of transmitting a control command comprises indirectly transmitting power and data signals through the door from the key controller to a corresponding data/power link that transfers such power and data signals to the lock controller.

15. The method of claim 13 and further including transferring data and programming information between the key controller and lock controller prior to engaging the actuator for the lock assembly.

16. The method of claim 13 and wherein the step of moving a release element comprises extending a plunger as said actuator is energized, urging the release element toward the lock element with the extension of the plunger and moving the lock element out of engagement with a lock housing to release the locking assembly.

17. The method of claim 16 and further including releasing a T-handle as the locking element is moved to its unlocked, nonengaging position and rotating the T-handle to disengage a locking post from a locking housing to enable opening of the door.

* * * * *